US012116775B2

(12) United States Patent
Klein et al.

(10) Patent No.: US 12,116,775 B2
(45) Date of Patent: Oct. 15, 2024

(54) SEALING ELEMENT, SEAL AND METHOD FOR INSTALLING A WALL CONFIGURATION

(71) Applicant: Hilti Aktiengesellschaft, Schaan (LI)

(72) Inventors: Manfred Klein, Kaufering (DE); Christian Förg, Buchloe (DE)

(73) Assignee: Hilti Aktiengesellschaft, Schaan (LI)

( * ) Notice: Subject to any disclaimer, the term of this patent is extended or adjusted under 35 U.S.C. 154(b) by 906 days.

(21) Appl. No.: 15/733,575

(22) PCT Filed: Apr. 8, 2019

(86) PCT No.: PCT/EP2019/058819
§ 371 (c)(1),
(2) Date: Sep. 2, 2020

(87) PCT Pub. No.: WO2019/201648
PCT Pub. Date: Oct. 24, 2019

(65) Prior Publication Data

US 2021/0010257 A1 Jan. 14, 2021

(30) Foreign Application Priority Data

Apr. 16, 2018 (EP) ..... 18167483

(51) Int. Cl.

| | |
|---|---|
| ***E04B 1/66*** | (2006.01) |
| ***E04B 1/68*** | (2006.01) |
| ***E04B 1/82*** | (2006.01) |
| ***E04B 1/94*** | (2006.01) |

(52) U.S. Cl.
CPC ..... *E04B 1/6815* (2013.01); *E04B 1/6812* (2013.01); *E04B 1/82* (2013.01); *E04B 1/946* (2013.01); *E04B 1/948* (2013.01)

(58) Field of Classification Search
CPC ..... E04B 1/6815; E04B 1/6812; E04B 1/82; E04B 2001/8281; E04B 1/941; E04B 1/946; E04B 1/948
See application file for complete search history.

(56) References Cited

U.S. PATENT DOCUMENTS

| | | | | |
|---|---|---|---|---|
| 4,923,348 A * | 5/1990 | Carlozzo | ..... | F16B 37/14 52/515 |
| 5,755,908 A * | 5/1998 | Rayburn | ..... | B25B 23/00 156/224 |
| 5,913,788 A | 6/1999 | Herren | | |

(Continued)

FOREIGN PATENT DOCUMENTS

| | | |
|---|---|---|
| EP | 3 284 872 | 2/2018 |
| JP | 2016-37717 | 3/2016 |

OTHER PUBLICATIONS

International Search Report issued Jun. 25, 2019 in PCT/EP2019/058819.
Written Opinion issued Jun. 25, 2019 in PCT/EP2019/058819.

*Primary Examiner* — Chi Q Nguyen
(74) *Attorney, Agent, or Firm* — Grüneberg and Myers PLLC

(57) ABSTRACT

A sealing element as well as a seal is for sealing a corrugation of a fluted metal deck. The sealing element is moldable and self-adhesive and has a predefined geometry adapted to seal the corrugation. Furthermore, a method is for installing a wall configuration, preferably a drywall configuration, to a fluted metal deck with corrugations.

9 Claims, 6 Drawing Sheets

(56) References Cited

U.S. PATENT DOCUMENTS

| | | | | |
|---|---|---|---|---|
| 6,086,972 | A * | 7/2000 | Rayburn | F16B 37/14 428/41.3 |
| 7,235,286 | B2 * | 6/2007 | Salameh | B29C 45/1671 428/140 |
| 8,728,608 | B2 * | 5/2014 | Maisch | E04B 2/789 428/140 |
| 10,472,819 | B2 * | 11/2019 | Klein | E04B 5/268 |
| 11,162,259 | B2 * | 11/2021 | Pilz | E04B 2/7457 |
| 11,560,712 | B2 * | 1/2023 | Pilz | E04B 1/941 |
| 2005/0095386 | A1 * | 5/2005 | O'Connor | B32B 27/12 428/40.1 |
| 2009/0223159 | A1 * | 9/2009 | Colon | E04B 2/7409 52/404.1 |
| 2014/0219719 | A1 * | 8/2014 | Hensley | E01C 11/14 404/57 |
| 2016/0017598 | A1 | 1/2016 | Klein et al. | |
| 2017/0306615 | A1 * | 10/2017 | Klein | E04B 1/946 |
| 2017/0314256 | A1 | 11/2017 | Foerg et al. | |
| 2018/0002917 | A1 | 1/2018 | Kleinhans et al. | |
| 2018/0171624 | A1 * | 6/2018 | Klein | E04B 5/268 |
| 2019/0316348 | A1 * | 10/2019 | Pilz | E04B 1/24 |
| 2019/0360195 | A1 * | 11/2019 | Pilz | E04B 1/948 |
| 2020/0340240 | A1 * | 10/2020 | Pilz | E04B 1/947 |
| 2021/0017761 | A1 * | 1/2021 | Klein | E04B 1/948 |
| 2021/0062502 | A1 * | 3/2021 | Archer | E04B 1/944 |
| 2021/0146173 | A1 * | 5/2021 | Förg | A62C 3/16 |

* cited by examiner

SEALING ELEMENT, SEAL AND METHOD FOR INSTALLING A WALL CONFIGURATION

CROSS-REFERENCE TO RELATED APPLICATIONS

This application is a National Stage entry under § 371 of International Application No. PCT/EP2019/058819 filed on Apr. 8, 2019, and which claims the benefit of European Application No. 18167483.9, filed on Apr. 16, 2018. The content of each of these applications is hereby incorporated by reference in its entirety.

BACKGROUND OF THE INVENTION

Field of the Invention

The present invention relates to a sealing element for sealing a corrugation of a fluted metal deck as well as a seal comprising such a sealing element.

Additionally, the invention is about a method for installing a wall configuration, preferably a drywall configuration, to a fluted metal deck with corrugations, especially wherein a wall plane of the wall configuration is positioned substantially perpendicular to a flute axis, wherein the wall configuration comprises a ceiling runner being mounted on a lower side of the fluted metal deck.

Description of Related Art

Fluted metal decks are known in the art. Very often, they are used in combination with wall configurations, especially drywall configurations. In this case, a ceiling runner is attached to the underside of the metal deck and a floor runner is attached to the floor. Between those two runners, studs are mounted in a way that a relative movement between the ceiling runner and the studs is permitted in a vertical direction. The studs, the ceiling runner and the floor runner form a frame to which gypsum boards can be attached in order to build a drywall configuration.

Usually, a defined movement joint is left between the lower side of the metal deck and the upper edges of the gypsum boards.

In order to provide a deck and wall configuration which is air-tight, sound-attenuating or even sound-proof, fire-resistant, smoke-proof and/or thermally isolating, the flutes of the metal deck, the small corrugations between fluted metal deck elements or in one of the fluted deck elements and the movement joint have to be sealed.

This is especially important for fire rated walls.

According to the state of the art, mineral wool is stuffed into the gaps mentioned above from both sides of the wall and subsequently coated, e. g. with a sprayable coating which acts as a smoke stopper.

The process of sealing involves several working steps and thus is cumbersome. Moreover, it involves working with mineral wool. As this material can cause skin irritation, workers have to put on protective clothing when in contact with mineral wool.

Furthermore, the quantity of mineral wool filled into the gaps and the quality of performing this work is heavily dependent on the person fulfilling this task. The result is a variation in the sealing quality.

Applying the spray coating represents an additional working step. Since the gypsum boards are already installed at the time the coating is being applied, the spray needs to be applied from both sides of the wall. This is time consuming for an operator having to perform this task.

SUMMARY OF THE INVENTION

The object of the invention is to further improve the sealing of fluted metal decks and associated movement joints between the metal deck and adjacent wall configurations, especially by improving the sealing of the corrugations mentioned above.

The invention provides a sealing element for sealing a corrugation of a fluted metal deck, having a predefined geometry, i.e. shape and volume, adapted to seal a corrugation between adjacent fluted deck elements or in one of the fluted deck elements, wherein the sealing element is moldable and self-adhesive. In this way, the sealing element is pre-portioned to provide a suitable amount of sealing material that ensures a secure sealing of a corrugation. Because the sealing element is moldable, the shape of the sealing element can be adapted to the individual shape of a corrugation, thereby guaranteeing a tight fit, especially when the sealing element is pressed into the corrugation. Further, by being self-adhesive the sealing element is easy to install as it sticks to the fluted metal decks even upside down so it does not fall off under its own weight when adhered to a ceiling.

DETAILED DESCRIPTION OF THE INVENTION

The sealing element can be elastic to better adapt its shape to the shape of a corrugation when applied to the corrugation. Thus, the sealing properties of the sealing element are improved. Also, an elastic sealing element keeps its shape before being applied, thereby ensuring its geometry is perfectly adapted to seal a corresponding corrugation, even when the sealing element was deformed prior to its use.

In an embodiment of the invention, the shape of the cross section of the sealing element corresponds to the shape of the cross section of the corrugation it is designed to seal. Thus, providing a better fit and seal. In the context of the invention, unless stated otherwise, all cross sections extend perpendicular to the direction the corrugations extend in.

As the corrugations between adjacent fluted deck elements or in one of the fluted deck elements have a generally triangular cross section, the sealing element may have a corresponding triangular cross section.

The cross sectional area of the sealing element can be larger than the cross sectional area of the corrugation to provide enough sealing material to securely seal the corrugation. Because the sealing element is moldable, it is still easy to apply and in particular can be applied in such a way that the sealed corrugation is flush with the metal deck sections adjacent to the corrugation.

In a further embodiment of the invention, the height of the sealing element is larger than the depth of the corrugation the sealing element is designed to seal. In this way, the sealing element protrudes form the corrugation when inserted in the corrugation so that it can be pressed more easily into the corrugation to ensure a tight fit.

The maximum width of the sealing element may be larger than the maximum width of the corrugation the sealing element is designed to seal. Thus, ensuring a tight seal.

The sealing element according to the invention can be made from an air-tight, sound-attenuating or even sound-proof, fire-resistant, smoke-proof and/or thermally isolating material, especially a putty or a butyl. In this way, the sealing properties and/or the fire rating of the sealing element are improved.

Furthermore, the invention provides a seal comprising a sealing element of the type mentioned above and a carrier strip, the sealing element being mounted on the carrier strip. The carrier strip has the function of a fixation aid and improves the application as well as the handling of the sealing element.

In an embodiment of the invention, the seal comprises a second sealing element of the type mentioned above, wherein the sealing elements are mounted on the same side of the carrier strip with a common orientation and in a predefined distance to each other. In this way, the application can be made more convenient because multiple sealing elements can be applied in a single step. Also the amount of material used to seal a corrugation for a corresponding wall configuration can be reduced as the section of the corrugation adjacent to the wall configuration is not sealed by a single continuous sealing element but by two sealing elements that are separated by a gap. The distance of the two sealing elements to each other preferably correlates to the track width of the corresponding wall configuration.

The carrier strip may comprises a supplementary section adapted to protrude from a corresponding track of a wall configuration, when the seal is mounted in a corrugation, to mark sealed corrugations which makes it easier to identify sealed corrugations, thereby improving the installation process.

Additionally, the invention provides a method for installing a wall configuration, preferably a drywall configuration, to a fluted metal deck with corrugations, especially wherein a wall plane of the wall configuration is positioned substantially perpendicular to a flute axis. The wall configuration comprises a ceiling runner being mounted on a lower side of the fluted metal deck. The method comprises the following steps:

a) inserting one or more sealing elements of the type mentioned above and/or one or more seals of the type mentioned above into corrugations of the fluted metal deck according to a track of the wall configuration and
b) subsequently mounting the ceiling runner and/or a top track seal to the track of the wall configuration with inserted sealing elements and/or seals.

Such a method is easy to perform and provides a secure sealing of the corrugations. Additional working steps in order to seal the corrugations in the metal deck are not necessary. As the sealing elements are mounted before the ceiling runner and the gypsum boards, the corrugations can be accessed very easily which makes the installation quick and easy.

BRIEF DESCRIPTION OF THE DRAWINGS

Different embodiments of the invention are shown in the attached drawings.

FIG. 1 shows a cross sectional view of a section of a metal deck element 10 with two flutes 12 and a corrugation 14 extending along a horizontal axis A (see also FIG. 10) that is perpendicular to the drawing plane in FIG. 1.

Figure 1:
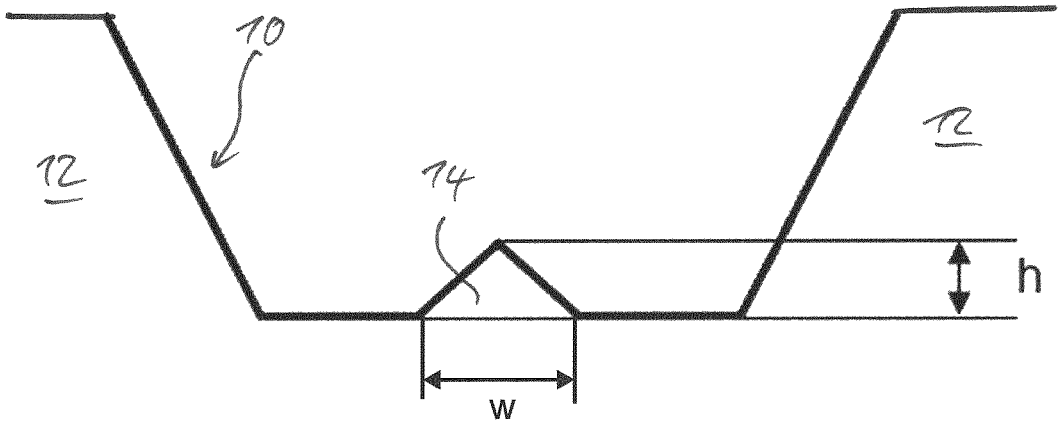
FIG. 1 shows a cross sectional view of a fluted metal deck section with a corrugation.

The corrugation 14 has a generally triangular cross section with a depth h and a width w when seen in mounted state along the horizontal axis A, which is the perspective taken in FIG. 1.

Figure 2:
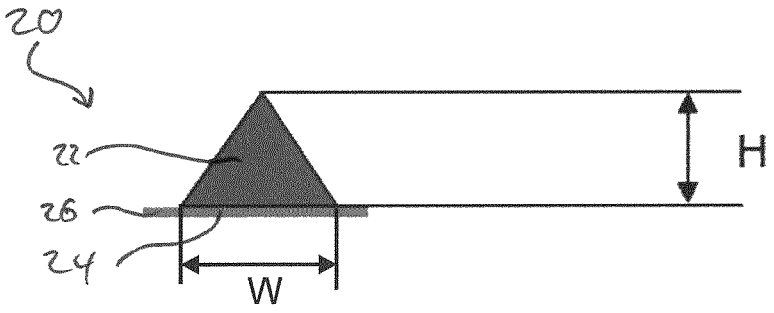
FIG. 2 shows a cross sectional view of a seal according to an embodiment of the invention comprising a sealing element according to an embodiment of the invention designed to seal the corrugation of FIG. 1.
Figure 3:
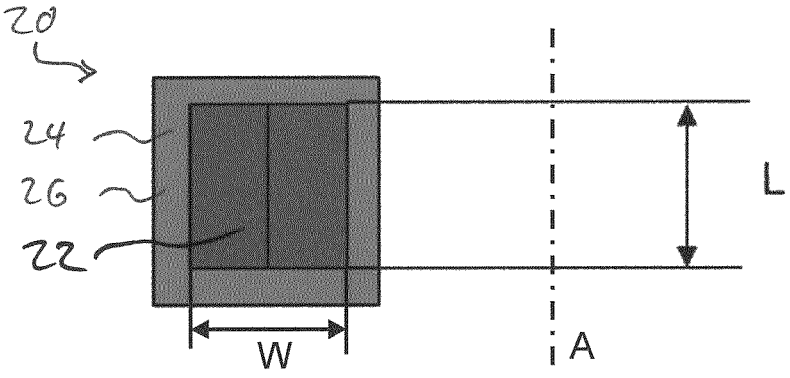
FIG. 3 shows a top view of the seal of FIG. 2.

FIGS. 2 and 3 show a seal 20 with a sealing element 22 mounted on a carrier strip 24.

The sealing element 22 has a generally triangular cross section with a height H and a width W when seen in mounted state along the horizontal axis A, which is the perspective taken in FIG. 2, as well as a length L the sealing element 22 extends in perpendicular to its cross section.

The height H and the width W of the sealing element 22 is larger than the depth h and the width w of the corrugation 14 respectively. Thus, the cross sectional area of the sealing element 22 is larger than the cross sectional area of the corrugation 14.

Preferably, the maximum width W of the sealing element 22 is larger than the maximum width w of the corrugation 14.

The length L of the sealing element 22 is defined by firestop requirements and is usually equal to or smaller than the track width T (see FIG. 10) of a wall configuration.

The sealing element 22 is made of a moldable and self-adhesive putty that is elastic, air-tight, sound-attenuating, fire-resistant, smoke-proof and thermally isolating.

In a different embodiment the sealing element 22 can be made of a different material, for example a butyl.

In a further embodiment, the sealing element 22 can comprise at least one of the following properties: elastic, air-tight, sound-attenuating, sound-proof, fire-resistant, smoke-proof and thermally isolating.

The sealing element 22 is pre-portioned so that it comprises enough material to ensure a tight seal of the corrugation 14 it is designed to seal.

In this way, the sealing element 22 is adapted to seal the corrugation 14 by its predefined shape and size.

The carrier strip 24 is a type of release paper that acts as a fixation aid and allows for easier handling of the seal 20 or sealing element 22.

The size of the carrier strip 24 is larger than the foot print, i.e. the base area W×L, of the sealing element 22. The sealing element 22 is centered on the carrier strip 24 with the result that the sealing element 22 is surrounded by a rim 26 of the carrier strip 24 protecting the sealing element 22 and improving its handling.

The sealing element 22 and the seal 20 respectively are adapted to seal the corrugation 14 in the fluted metal deck element 10. Further, the sealing element 22 and the seal 20 respectively are adapted to seal a corrugation between adjacent fluted metal deck elements, wherein the corrugation corresponds in size and shape to the corrugation 14 in the fluted metal deck element 10.

The embodiment of the sealing element 22 shown in FIGS. 2 and 3 has a cross section with a shape that corresponds to the shape of the cross section of the corrugation 14 as both cross sections are triangular with a similar shape.

Because the sealing element 22 is moldable, its cross section can also be rectangular, round shaped or can have any other shape as long as its cross section guarantees a secure seal of the corrugation 14. This is the case if the cross sectional area of the sealing element 22 is at least as large as the cross sectional area of the corrugation 14. Also, for corrugations 14 with no or minimal undercuts a tight seal can be ensured if the height H and the width W of the sealing element 22 are larger than the height h and the width w of the corresponding corrugation 14 respectively.

Two alternative embodiments of a seal 20 with a sealing element 22 with an alternative cross section are shown in FIGS. 4 to 7. Apart from the different geometry, the seals 20 and sealing elements 22 correspond to the seal 20 and sealing element 22 described above. The same reference symbols are used for the components that are known from the first embodiment and reference is made to the previous explanations in this respect.

Figure 4:
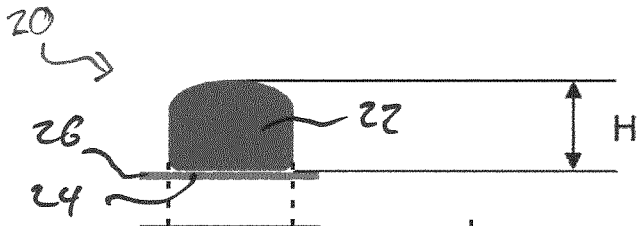
FIG. 4 shows a cross sectional view of a seal according to another embodiment of the invention comprising a sealing element according to another embodiment of the invention.
Figure 5:
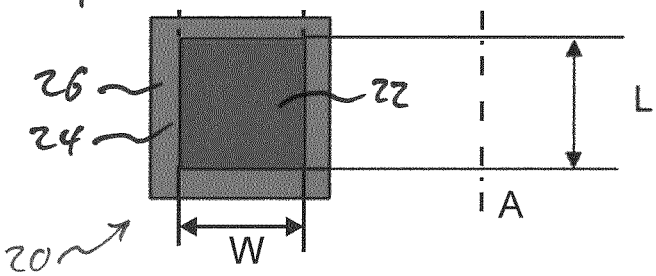
FIG. 5 shows a top view of the seal of FIG. 4.

The embodiment shown in FIGS. 4 and 5 has a cross section in the form of a rectangular with rounded corners.

Figure 6:
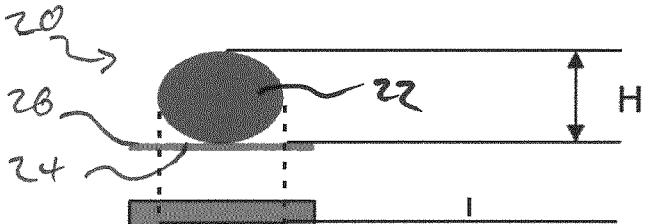
FIG. 6 shows a cross sectional view of a seal according to a further embodiment of the invention comprising a sealing element according to a further embodiment of the invention.
Figure 7:
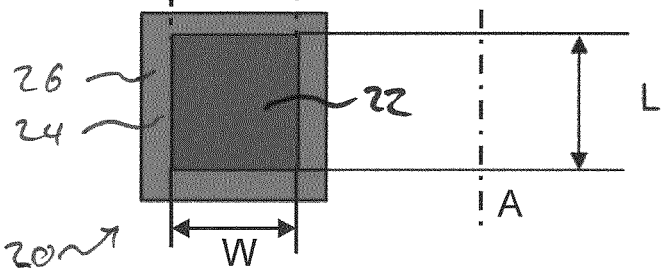
FIG. 7 shows a top view of the seal of FIG. 6.

The embodiment shown in FIGS. 6 and 7 has a cross section with an oval shape.

Figure 8:
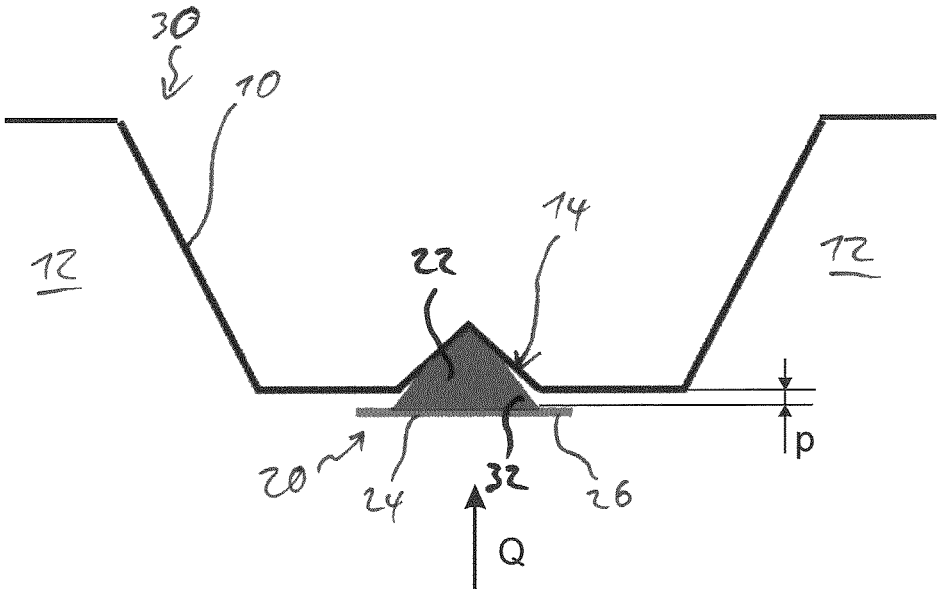
FIG. 8 shows a first step of a method for installing a wall configuration to a fluted metal deck with corrugations, according to an embodiment of the invention.

To seal a corrugation 14 in a metal deck element 10 of a fluted metal deck 30 with the seal 20, the sealing element 22 is inserted in the corrugation 14 with enough pressure so that the sealing element 22 adheres to the metal deck element 10 (see FIG. 8). Due to the sealing elements 22 self-adhesive properties, the sealing element 22 remains in place without the need of additional fixing elements.

The sealing element 22 has a section 32 which protrudes a distance p perpendicular to the plane defined by the fluted metal deck 30 out of the corrugation 14.

The carrier strip 24 covers the protruding section 32 of the sealing element 22 and is arranged completely outside of the corrugation 14 to prevent the carrier strip 24 from getting in between the sealing element 22 and the metal deck element 10 which might weaken the sealing of the corrugation 14 by the seal 20.

The protruding section 32 is then pressed in direction Q towards the corrugation 14 which results in the sealing element 22 completely filing the cross section of the corrugation 14 and sealing the corrugation 14 tight.

The carrier strip 24 facilitates these steps as it prevents the sealing element 22 from getting into contact with and thus from sticking to the fingers of a user.

Figure 10:
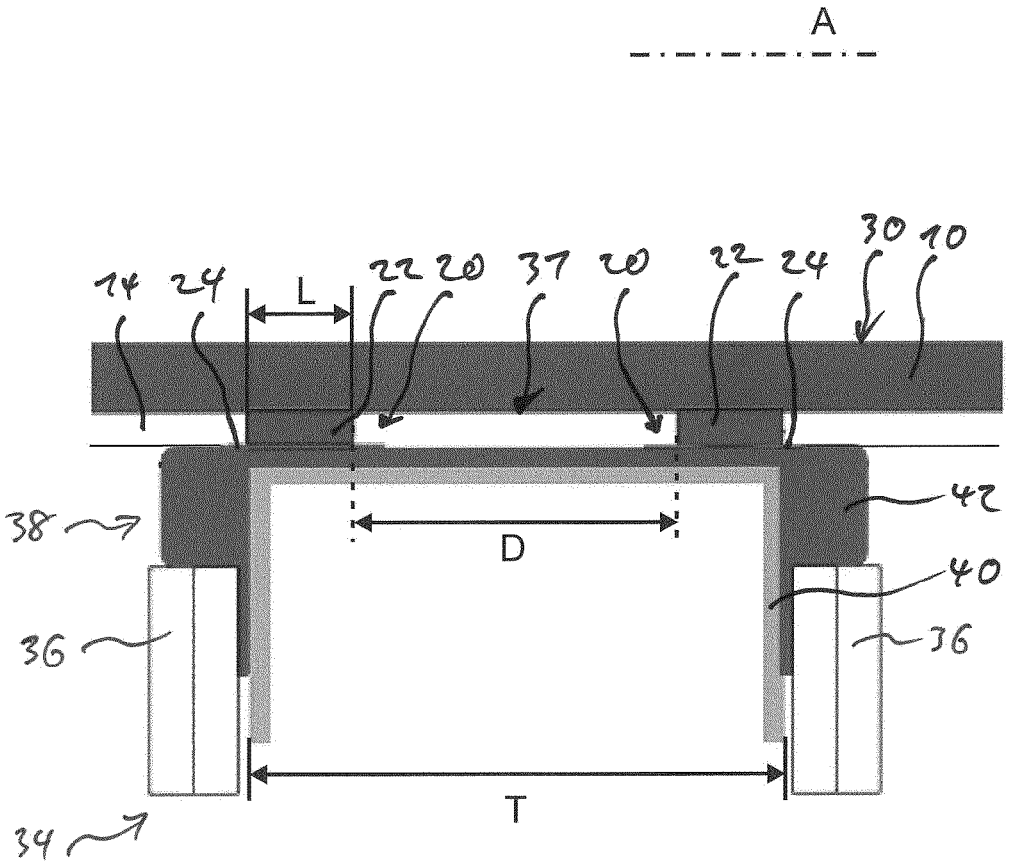
FIG. 10 shows a cross sectional view of a wall configuration with two seals of FIG. 2.

The sealing element 22 can also be used to seal the corrugations 14 for the installation of a wall configuration 34 to the fluted metal deck 30 (see FIG. 10).

The wall configuration 34 is a drywall configuration.

In the example shown, the wall configuration 34 which defines a wall plane, comprises two gypsum boards 36 as well as a ceiling runner 38 with a top track 40 and a pre-formed top track seal 42, wherein the ceiling runner 38 is designed to be mounted on a lower side of the fluted metal deck 30.

In the embodiment, the wall plane of the wall configuration 34 is positioned substantially perpendicular to the horizontal axis A in which the flutes 12 and corrugations 14 of the fluted metal deck 30 extend in as well as substantially perpendicular to the plane defined by the fluted metal deck 30.

In an alternative embodiment, the ceiling runner 38 can comprise a top track 40 and/or a, especially pre-formed, top track seal 42.

To install the wall configuration 34 to the fluted metal deck 30 the following method is used.

In a first step, sealing elements 22 are inserted into the corrugations 14 as described above along the track 31 of the wall configuration 34 which is the section of the fluted metal deck 30 adjacent to the wall configuration 34, especially adjacent to the top track 40.

To save material, two sealing elements 22 per corrugation 14 (see FIG. 10) are used to seal the corrugations 14 along the track 31.

The sealing elements 22 of the two seals 20 are positioned on both sides of the track 31, wherein the distance D between the two sealing elements 22 is smaller than the track width T of the top track 40.

In an alternative embodiment, a single sealing element 22 per corrugation 14 along the track 31 can be used which is preferably positioned in the middle of the track 31, i.e. equally distanced to the two gypsum boards 36.

Figure 9:
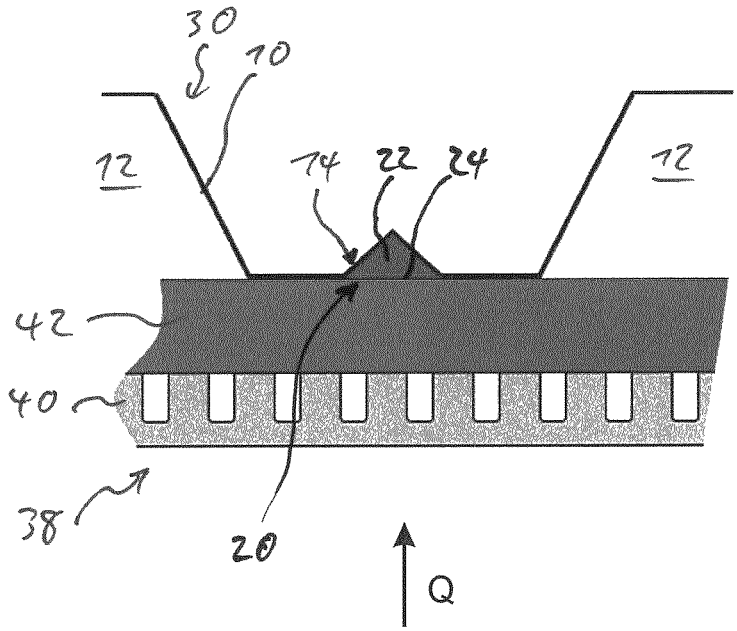
FIG. 9 shows a second step of the method of FIG. 8.

In the next step, the ceiling runner 38 is mounted to the metal deck 30 whereby the ceiling runner 38 presses the sealing elements 22 in the respective corrugations 14 which as a result are sealed tight (see FIG. 9).

In this way, the sealing elements 22 are pressed into the corrugations 14 by the ceiling runner 38 when the ceiling runner 38 is mounted to the metal deck 30 and thus do not need to be pressed into the corrugations 14 individually.

The carrier strips 24 of the seals 20 which separate the sealing elements 22 from the ceiling runner 38 prevent the sealing elements 22 from sticking to the ceiling runner 38 and thus facilitate mounting the ceiling runner 38 to the metal deck 30 by allowing the ceiling runner 38 to be arranged freely.

In a different embodiment, instead of a ceiling runner 38 with a top track 40 and a pre-formed top track seal 42, the sealing elements 22 can be pressed into the corrugations 14 by a top track 40 and/or a, especially pre-formed, top track seal 42 when the respective component is mounted to the metal deck 30.

Figure 11:
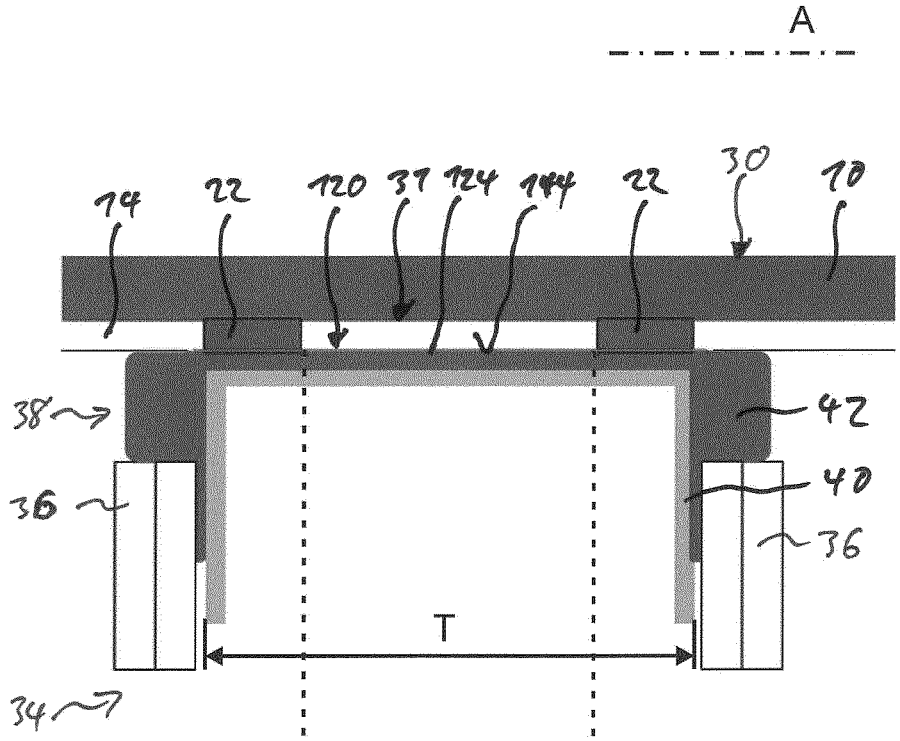
FIG. 11 shows a cross sectional view of a wall configuration with a seal according to a further embodiment of the invention.
Figure 12:
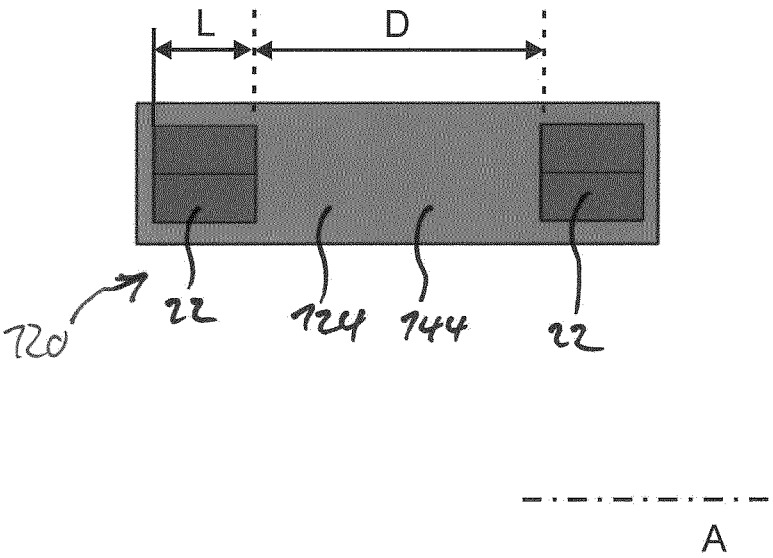
FIG. 12 shows a top view of the seal of FIG. 11.

In an alternative embodiment a seal 120 comprises multiple sealing elements 22. A seal 120 with two sealing elements 22 is shown in FIGS. 11 and 12. Apart from the differences described below, the seal 120 and the sealing elements 22 correspond to the seals 20 and sealing elements 22 described above. Corresponding reference symbols are used for the components that are known from the embodiments above and reference is made to the previous explanations in this respect.

The two sealing elements 22 of the seal 120 are both mounted on the top side 144 of the carrier strip 124 and in a predefined distance D to each other which is smaller than the track distance T of the top track 40 the seal 120 is designed for (see FIG. 11).

The sealing elements 22 have the same orientation and are aligned along the horizontal axis A in such a way that they are adapted to be inserted together in a respective corrugation 14.

In this way, the application of the sealing elements 22 to seal a corrugation 14 is made more convenient while at the same time the material saving solution of using two separate sealing elements 22 instead of a single one is retained.

Figure 14:
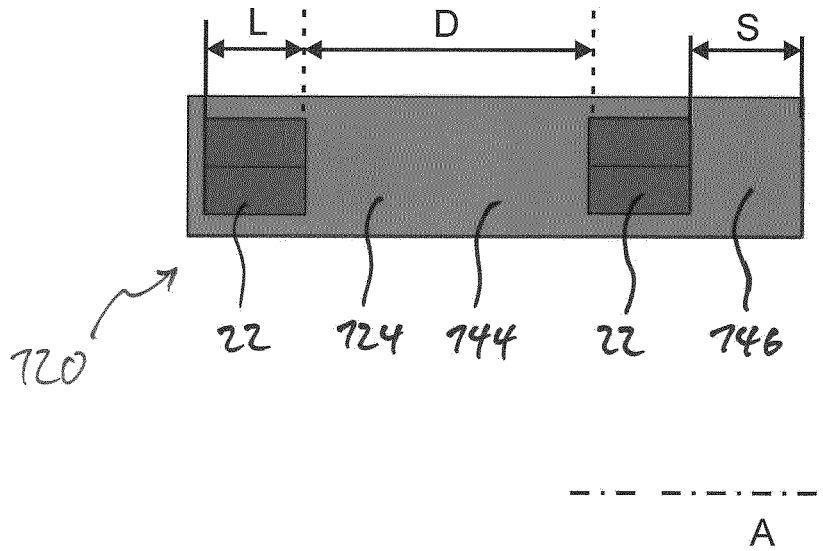
FIG. 14 shows a top view of the seal of FIG. 13.

In a further alternative embodiment, the carrier strip 124 of the seal 120 comprises a supplementary section 146 with a length S (see FIG. 14) that extends the carrier strip 124 along the horizontal axis A.

Figure 13:
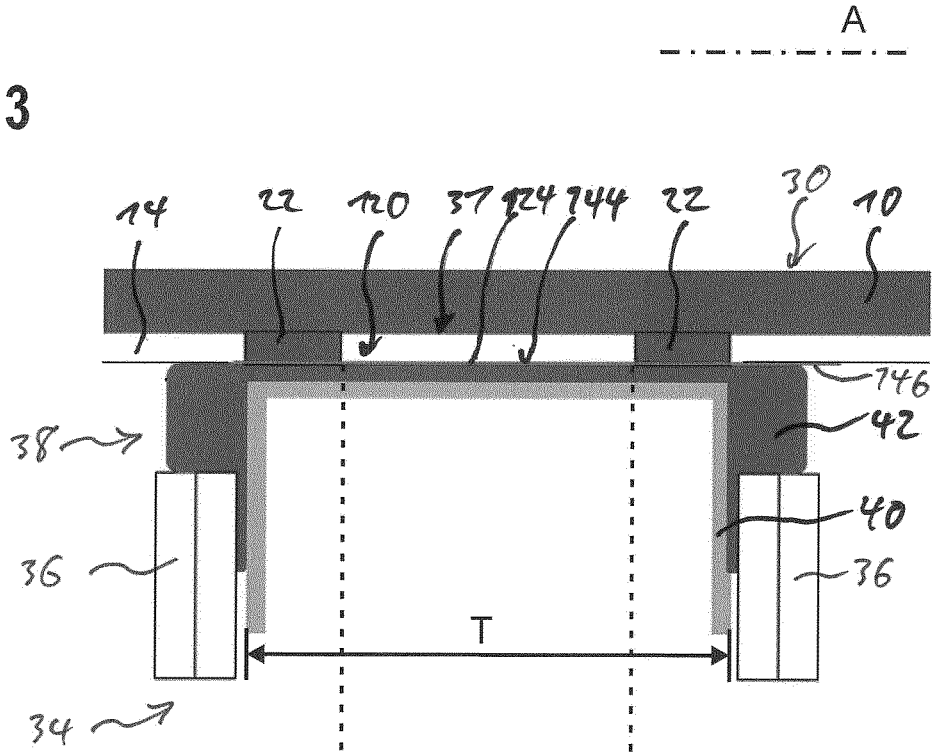
FIG. 13 shows a cross sectional view of a wall configuration with a seal according to a further embodiment of the invention.

The supplementary section 146 is designed to protrude from the track 31 when the seal 120 is mounted in a corrugation 14 (see FIG. 13), to indicate that a seal 120 is installed and thus the respective corrugation 14 is sealed.

In a further alternative embodiment, the carrier strip 124 can comprise a supplementary section 146 on each end so that the carrier strip 124 protrudes from both sides of the track 31 in horizontal direction A. Thus the seal 120 can be identified from both sides of the wall configuration 34.

The supplementary section 146 is not limited to seals 120 with multiple sealing elements 22. Seals 20 with a single sealing element 22 can also comprise a carrier strip 24 with a supplementary section 146 and respective functionality.

The seals 20, 120 can be provided in the form of a continuous strip, for example on a roll or in a box. In this case the individual seals 20, 120 can be separated by markings, especially perforations, which allow for easy identification and convenient availability of single seals 20, 120. Especially in the case of perforations, single seals 20, 120 can be teared-off without the need of a tool.

The sealing elements 22, seals 20,120 and the method described above improve the sealing of corrugations 14 of a flute metal deck 30 in the following ways:

The corrugations 14 can be tightly sealed in a short amount of time without the need of additional tools.

The sealing elements 22 or seals 20,120 can be installed during the installation of the ceiling runner 38, the top track 40 and/or a top track seal 42. In this way, the corrugations 14 are easily accessible and no additional "ladder climbing" is required.

The sealing of the corrugations 14 is failure proof as the pre-manufactured seals 20, 120 or sealing elements 22 ensure that the necessary material required for a tight seal is installed.

Further, the sealing of the corrugations 14 requires no curing time because the material, the sealing elements 22 are made of, is already cured.

The invention claimed is:

1. A method for installing a wall configuration to a fluted metal deck with corrugations, wherein the wall configuration comprises a ceiling runner being mounted on a lower side of the fluted metal deck, the method comprising:

inserting one or more of a sealing element and/or one or more seals comprising the sealing element and a carrier strip into at least one of the corrugations of the fluted metal deck according to a track of the wall configuration, and subsequently mounting the ceiling runner and/or a top track seal to the track of the wall configuration with the inserted one or more of the sealing element and/or one or more seals, wherein the sealing element is a sealing element for sealing a corrugation of a fluted metal deck, having a shape and volume adapted to seal the corrugation between adjacent fluted deck elements or in one of the fluted deck elements, wherein the sealing element is moldable and self-adhesive.

2. The method according to claim 1, wherein the wall configuration is a drywall configuration.

3. The method according to claim 1, wherein a wall plane of the wall configuration is positioned substantially perpendicular to a flute axis.

4. The method according to claim 1, wherein the sealing element is elastic.

5. The method according to claim 1, wherein a cross sectional area of the sealing element is larger than a cross sectional area of the corrugation.

6. The method according to claim 1, wherein a height of the sealing element is larger than a depth of the corrugation.

7. The method according to claim 1, wherein a maximum width of the sealing element is larger than a maximum width of the corrugation.

8. The method according to claim 1, wherein the sealing element is made from a material, wherein the material is at least air-tight, sound-attenuating or sound-proof, fire-resistant, smoke-proof, and/or thermally isolating.

9. The sealing method according to claim 8, wherein the material is a putty or a butyl.

* * * * *